US011665455B2

(12) United States Patent
Hua et al.

(10) Patent No.: US 11,665,455 B2
(45) Date of Patent: May 30, 2023

(54) WINDSCREEN MESH

(71) Applicant: Apple Inc., Cupertino, CA (US)

(72) Inventors: Thanh P. Hua, San Jose, CA (US); Jarrett B. Lagler, San Francisco, CA (US); Brian R. Twehues, San Jose, CA (US); Ethan L. Huwe, Campbell, CA (US); Mei Zhang, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 24 days.

(21) Appl. No.: 16/901,937

(22) Filed: Jun. 15, 2020

(65) Prior Publication Data

US 2021/0099778 A1 Apr. 1, 2021

Related U.S. Application Data

(60) Provisional application No. 62/906,556, filed on Sep. 26, 2019.

(51) Int. Cl.
*H04R 1/02* (2006.01)

(52) U.S. Cl.
CPC ..... *H04R 1/02* (2013.01); *H04R 2410/07* (2013.01)

(58) Field of Classification Search
CPC ..... H04R 1/02; H04R 2410/07; H04R 1/023; H04R 1/026; H04R 1/086; H04R 2410/01; H04R 2410/03; H04R 2499/11
See application file for complete search history.

(56) References Cited

U.S. PATENT DOCUMENTS

| | | | | |
|---|---|---|---|---|
| 5,652,413 | A | 7/1997 | Mulera | |
| 5,944,197 | A | 8/1999 | Baltzer et al. | |
| 8,055,003 | B2 | 11/2011 | Mittleman et al. | |
| 9,014,411 | B2 | 4/2015 | Rodgers | |
| 9,788,620 | B1 | 10/2017 | Parkinson | |
| 10,841,675 | B2 | 11/2020 | Howard et al. | |
| 2006/0291686 | A1* | 12/2006 | Hlas | H04R 1/086 381/381 |
| 2009/0046882 | A1* | 2/2009 | Sakurai | H04R 1/083 381/361 |
| 2012/0082336 | A1 | 4/2012 | Wubker et al. | |
| 2012/0253798 | A1* | 10/2012 | Walters | H04R 1/406 704/226 |
| 2014/0254852 | A1* | 9/2014 | Haapapuro | H04R 1/086 381/359 |
| 2015/0304754 | A1* | 10/2015 | Akino | H04R 1/086 381/361 |
| 2020/0107109 | A1 | 4/2020 | Cousins et al. | |
| 2021/0245675 | A1* | 8/2021 | Yoshino | B60R 11/0247 |

FOREIGN PATENT DOCUMENTS

| | | |
|---|---|---|
| CN | 108429960 A | 8/2018 |
| CN | 208940166 U | 6/2019 |

OTHER PUBLICATIONS

First Office Action for Chinese Application No. 202010766617.X dated Jan. 10, 2023, with original CN office action (18 pages).

* cited by examiner

*Primary Examiner* — Alexander Krzystan
*Assistant Examiner* — Julie X Dang
(74) *Attorney, Agent, or Firm* — Aikin & Gallant, LLP

(57) ABSTRACT

An acoustic mesh comprising a first portion that is acoustically closed; and a second portion that surrounds the first portion and is acoustically open, wherein a surface area of the second portion is at least one percent a total surface area of the acoustic mesh.

19 Claims, 6 Drawing Sheets

WINDSCREEN MESH

CROSS-REFERENCE TO RELATED APPLICATION

This application claims the benefit of the earlier filing date of U.S. Provisional Patent Application No. 62/906,556, filed Sep. 26, 2019 and incorporated herein by reference.

FIELD

An embodiment of the invention is directed to an acoustic mesh for attenuating wind noise without impacting a frequency response of an associated microphone. Other embodiments are also described and claimed.

BACKGROUND

Portable listening devices can be used with a wide variety of electronic devices such as portable media players, smart phones, tablet computers, laptop computers, stereo systems, and other types of devices. Portable listening devices have historically included one or more small speakers configured to be placed on, in, or near a user's ear, structural components that hold the speakers in place, and a cable that electrically connects the portable listening device to an audio source. Other portable listening devices can be wireless devices that do not include a cable and instead, wirelessly receive a stream of audio data from a wireless audio source. Such portable listening devices can include, for instance, wireless earbud devices or in-ear hearing devices that operate in pairs (one for each ear) or individually for outputting sound to, and receiving sound from, the user.

While wireless listening devices have many advantages over wired portable listening devices, they also have some potential drawbacks. For example, it may be difficult to achieve high-end acoustic performance from the listening devices due to the limited amount of space available within each listening device. Also, some wireless listening devices that extend into the ear canal to achieve better performance can often have an improper seal between the portable listening device and the ear canal, causing the user to experience lower quality sound. Further, the small size of wireless listening devices often causes a compromise in user interface features, blockage of sensors and/or microphones, and lower overall user experience.

SUMMARY

Portable listening devices such as earbuds may include a microphone, for example, an external microphone that picks up sounds from the ambient environment surrounding the device. For example, the microphone may pick up the user's voice, pick up ambient noise (e.g., for noise cancellation), or be used for other purposes. A microphone picking up sounds from the ambient environment may, however, be sensitive to undesirable sounds such as wind noise, particularly in cases where the microphone signal is amplified. To reduce the sensitivity of the microphone to undesirable wind noise, the instant invention includes an acoustic shield coupled to an acoustic port from the ambient environment to the microphone. The acoustic shield may be an acoustic mesh that has particular dimensions that have been found to reduce (or attenuate) wind noise (or other undesirable ambient sounds) without impacting a frequency response of the microphone (e.g., without attenuating desired sounds such as speech). For example, the acoustic mesh may be acoustically closed at a center portion and acoustically open around a perimeter portion. The acoustically open and acoustically closed portions may be specially selected to provide the same wind protection (or attenuation) as opening the whole area (e.g., an acoustic mesh without an acoustically closed center portion) without impacting the frequency response of the microphone. In some aspects, the acoustic mesh including open and closed portions may achieve a maximum wind attenuation up to 10 decibels (dB).

In one aspect, an acoustic mesh includes a first portion that is acoustically closed; and a second portion that surrounds the first portion and is acoustically open. The acoustic mesh may be configured to provide comparable wind noise attenuation in comparison to an acoustic mesh without the first portion, without affecting a frequency response of a microphone to which the acoustic mesh is acoustically coupled. In some aspects, the first portion is at a center of the acoustic mesh. The first portion may be acoustically closed by coupling a support member to a surface of the first portion. The second portion may be near a perimeter of the acoustic mesh. The second portion may be a ring shaped portion positioned around the first portion. The first portion may include a number of portions that acoustically close different sections of the acoustic mesh. The first portion have a diameter, and the diameter of the first portion may be 1.5 cm or less. The attenuation of wind noise may be 10 decibels or less. The acoustic mesh may be coupled to an acoustic port of an enclosure that the microphone is positioned within.

In another aspect, an acoustic shielding assembly includes an acoustic mesh, a support member coupled to the acoustic mesh to acoustically close a portion of the acoustic mesh, and a dimension of the support member is selected to allow the acoustic mesh to attenuate wind noise without affecting a frequency response of a microphone to which the acoustic mesh is acoustically coupled. In some aspects, a portion of the acoustic mesh is a first portion and a second portion of the acoustic mesh surrounding the first portion is acoustically open. In some aspects, a dimension of the support member is a radius and the acoustic mesh comprises a radius that is greater than the radius of the support member. In some aspects, a diameter of the acoustic mesh is 1.5 cm or less. The attenuation of the wind noise may be 10 decibels or less. The acoustic mesh may be coupled to an acoustic port that opens to an acoustic cavity of the microphone. The support member may be a post positioned within the acoustic cavity and that extends to the acoustic mesh.

In another aspect, a portable electronic device includes an enclosure having an acoustic port that acoustically couples an acoustic cavity within the enclosure to a surrounding ambient environment; a microphone positioned within the enclosure and acoustically coupled to the acoustic cavity; and an acoustic mesh coupled to the acoustic port, the acoustic mesh having a first portion that is acoustically closed and a second portion that is acoustically open and surrounds the first portion, and wherein the acoustic mesh attenuates wind noise from the ambient environment without affecting a frequency response of the microphone. The acoustically closed first portion may prevent a wind noise from the ambient environment from entering the acoustic cavity. The acoustically closed first portion may be at a center of the acoustic mesh. A support member may extend from the acoustic cavity to the first portion of the acoustic mesh to acoustically close the first portion of the acoustic mesh, and wherein the support member comprises a radius that is smaller than a radius of the acoustic port.

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

The embodiments are illustrated by way of example and not by way of limitation in the figures of the accompanying drawings in which like references indicate similar elements. It should be noted that references to "an" or "one" embodiment in this disclosure are not necessarily to the same embodiment, and they mean at least one.

DETAILED DESCRIPTION

In this section we shall explain several preferred aspects of this invention with reference to the appended drawings. Whenever the shapes, relative positions and other aspects of the parts described in the aspects are not clearly defined, the scope of the invention is not limited only to the parts shown, which are meant merely for the purpose of illustration. Also, while numerous details are set forth, it is understood that some aspects of the invention may be practiced without these details. In other instances, well-known structures and techniques have not been shown in detail so as not to obscure the understanding of this description.

The terminology used herein is for the purpose of describing particular aspects only and is not intended to be limiting of the invention. Spatially relative terms, such as "beneath", "below", "lower", "above", "upper", and the like may be used herein for ease of description to describe one element's or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (e.g., rotated 90 degrees or at other orientations) and the spatially relative descriptors used herein interpreted accordingly.

As used herein, the singular forms "a", "an", and "the" are intended to include the plural forms as well, unless the context indicates otherwise. It will be further understood that the terms "comprises" and/or "comprising" specify the presence of stated features, steps, operations, elements, and/or components, but do not preclude the presence or addition of one or more other features, steps, operations, elements, components, and/or groups thereof.

The terms "or" and "and/or" as used herein are to be interpreted as inclusive or meaning any one or any combination. Therefore, "A, B or C" or "A, B and/or C" mean "any of the following: A; B; C; A and B; A and C; B and C; A, B and C." An exception to this definition will occur only when a combination of elements, functions, steps or acts are in some way inherently mutually exclusive.

Figure 1:
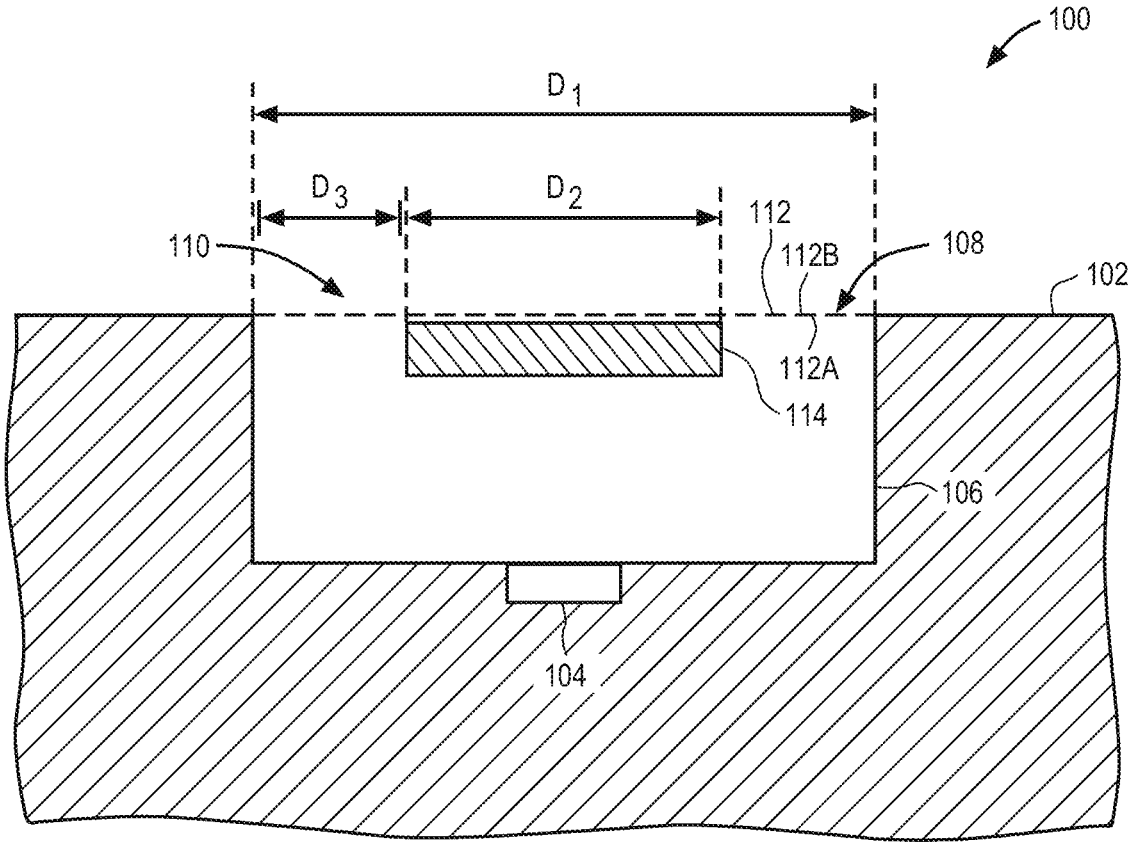
FIG. 1 illustrates a simplified schematic cross-sectional side view of one aspect of an acoustic shielding assembly.

FIG. 1 illustrates a cross-sectional simplified schematic side view of one aspect of an acoustic shielding assembly coupled to a transducer assembly. Assembly 100 may include a device frame, housing, or enclosure 102 within which various device components may be integrated, housed, contained, or otherwise positioned. One such component is a transducer 104. Transducer 104 may be positioned within enclosure 102 and acoustically coupled to an acoustic port 108 formed through the wall of enclosure 102. In some aspects, an acoustic cavity 106 is formed between transducer 104 and acoustic port 108 such that, for example, an acoustic input from the ambient environment that enters the enclosure through the acoustic port 108, travels through the acoustic cavity prior to reaching transducer 104. Representatively, in one aspect transducer 104 may be a microphone that converts sound (e.g., audible acoustic signals) into electrical signals. For example, sound from the ambient environment may enter enclosure 102 through acoustic port 108, and travel through acoustic cavity 106 to transducer 104. The sound is then picked up by transducer 104 (e.g., microphone), which then converts the sound to an electrical signal for further processing (e.g., noise cancellation). In some aspects, however, the sound or acoustic input may also include undesirable wind noise from the ambient environment. To reduce the impact of the undesirable wind noise on the transducer 104, assembly 100 may further include an acoustic shielding assembly 110.

Acoustic shielding assembly 110 may be any type of shielding assembly suitable for attenuating, or otherwise decreasing, undesirable wind noise without impacting a frequency response of transducer 104. Representatively, shielding assembly 110 may include an acoustic material, for example, acoustic mesh 112. Acoustic mesh 112 may be constructed as a single layer with contours that conform to a topography of an external surface of enclosure 102. In some instances, acoustic mesh 112 can be a porous layer that is tuned to a specific acoustic impedance to enable proper operation of the underlying transducer 104. In some embodiments, acoustic mesh 112 is formed of a pliable, porous material, such as a porous polyester. Acoustic mesh 112 can be covered with a hydrophobic coating that enables acoustic mesh 112 to resist ingress of water into the housing of the wireless listening device. In some embodiments, although not shown, acoustic mesh 112 may be positioned between a cosmetic mesh and a stiffener. Acoustic mesh 112 may be attached to enclosure 102, and dimensioned to completely cover acoustic port 108 and acoustic cavity 106. An external surface 112A of acoustic mesh 112 may be exposed (or face) the ambient environment, and in some cases may be planar with the external surface of enclosure 102. An internal surface of acoustic mesh 112 may be exposed, share a volume with, or otherwise face, acoustic cavity 106.

Acoustic shielding assembly 110 may further include support member 114, which may abut, contact, or otherwise be positioned against, internal surface 112A of acoustic mesh 112. Support member 114 may, for example, be any type of structure that provides structural rigidity to acoustic mesh 112 (e.g., prevents mesh 112 from deformation during drop events) and occludes a portion of acoustic mesh 112. Acoustic mesh 112 is therefore acoustically open except where it is covered by support member 114. Acoustic mesh 112 is considered acoustically closed in the regions or areas where it is in contact with, or otherwise covered by, support member 114. The term "acoustically open" is intended to mean that sounds, wind noise, or the like from the ambient environment may pass through acoustic mesh 112 to transducer 104. The term "acoustically closed" is intended to mean that sounds, wind noise, or the like from the ambient environment may not pass, or are otherwise prevented from passing, through acoustic mesh 112 to transducer 104.

The size, surface area and/or dimensions of acoustic mesh 112 relative to support member 114 may be specially selected so that they achieve a wind noise attenuation of, for example, up to 10 decibels (dB) without impacting a frequency response of transducer 104. Representatively, in one aspect, acoustic mesh 112 may have a dimension D1. Dimension D1 may correspond to, for example, an overall maximum dimension (e.g., width, outer radius, outer diameter, surface area, etc) of acoustic mesh 112 covering acoustic port 108. Dimension D1 may therefore also correspond to an overall maximum dimension of acoustic port 108. Support member 114 may have an overall dimension D2. Dimension D2 may correspond to, for example, an overall maximum dimension (e.g., width, inner radius, inner diameter, surface area, etc) of the portion of support member 114 contacting, or otherwise occluding, acoustic mesh 112. Dimension D2 may therefore also be understood as corresponding to an acoustically closed portion, region or surface of acoustic mesh 112. In some aspects, dimension D2 is less than dimension D1 such that at least a portion of acoustic mesh 112 remains open. Dimension D3, in turn, illustrates the difference between dimension D1 and dimension D2, or the open region or portion of acoustic mesh 112 surrounding the closed region (e.g., dimension D1-dimension D2). The dimension D3 may be considered the critical dimension necessary to achieve a maximum wind attenuation without impacting a frequency response. For example, in some aspects, at least 1 percent (%) of acoustic mesh 112 remains open. Therefore, in some aspects, D1, D2 and D3 may be defined relative to one another, for example, as D3/D1>0.01, or D2/D3<99 and D2/D1<0.99. In the illustrated configuration, support member 114 is in contact with a central region of support member 114 so that the acoustic mesh 112 is acoustically closed near the center and acoustically open near the perimeter. The size of the open perimeter portion, dimension or area can be selected to provide comparable wind noise attenuation in comparison to an acoustic mesh without support member 114 (e.g., completely open acoustic mesh).

Figure 2:
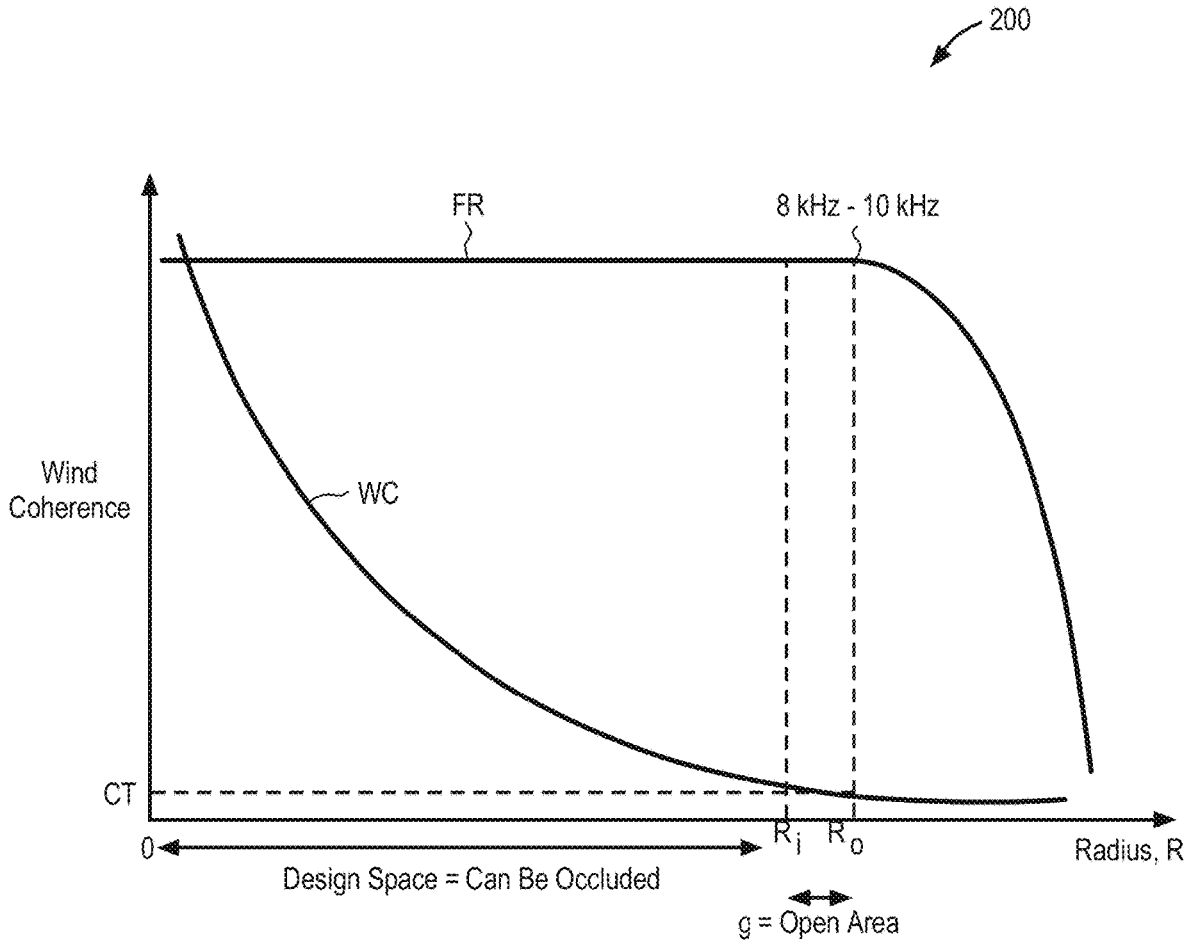
FIG. 2 illustrates a graph representing a wind noise attenuation achieved using an acoustic shielding assembly.

FIG. 2 illustrates a graph representing how the critical dimensions of an acoustic shielding assembly can be arrived at for optimum wind attenuation without impacting the frequency response. In particular, graph 200 illustrates a maximum dimension of a circular acoustic port 108 that may be occluded by the support member 114 to achieve the desired wind noise attenuation without impacting the frequency response of transducer 104. Representatively, the y-axis represents the wind coherence and the x-axis represents a radius (R) of the acoustic port (e.g., outer radius of acoustic port 108). As can be generally seen from graph 200, as the dimension of the acoustic port increase (e.g., radius (R) increases), the wind coherence decreases, as illustrated by the wind coherence curve (WC), thereby increasing acoustic benefits. The frequency response (FR), or desired sound, is further illustrated by the frequency response curve labeled "FR". In particular, it can be seen from the graph that the frequency response (FR) is flat up to about 8-10 kHz. The point at which the frequency (FR) is no longer flat or drops off, for example after about 8-10 kHz, is then used to determine the maximum desired or critical dimension of the acoustic port. In this example, for the sake of simplicity, the port is assumed to be circular so the maximum critical dimension may be defined as the outer radius (Ro) of the acoustic port. The critical dimension of the support member, or inner radius (Ri), relative to the acoustic port dimension (outer radius Ro), can then be determined based on a determined coherence threshold (CT). The coherence threshold (CT) is the point below which the coherence is low enough to achieve the desired maximum attenuation. In other words, the graph 200 shows that the acoustic port dimension (Ro) can be occluded up to a maximum inner radius (Ri) (e.g., a maximum radius of support member) before the frequency response is impacted. The difference between the outer radius (Ro) and inner radius (Ri) is the remaining open area (g), which may vary depending on the size of the port and occluded region as shown.

Figure 3:
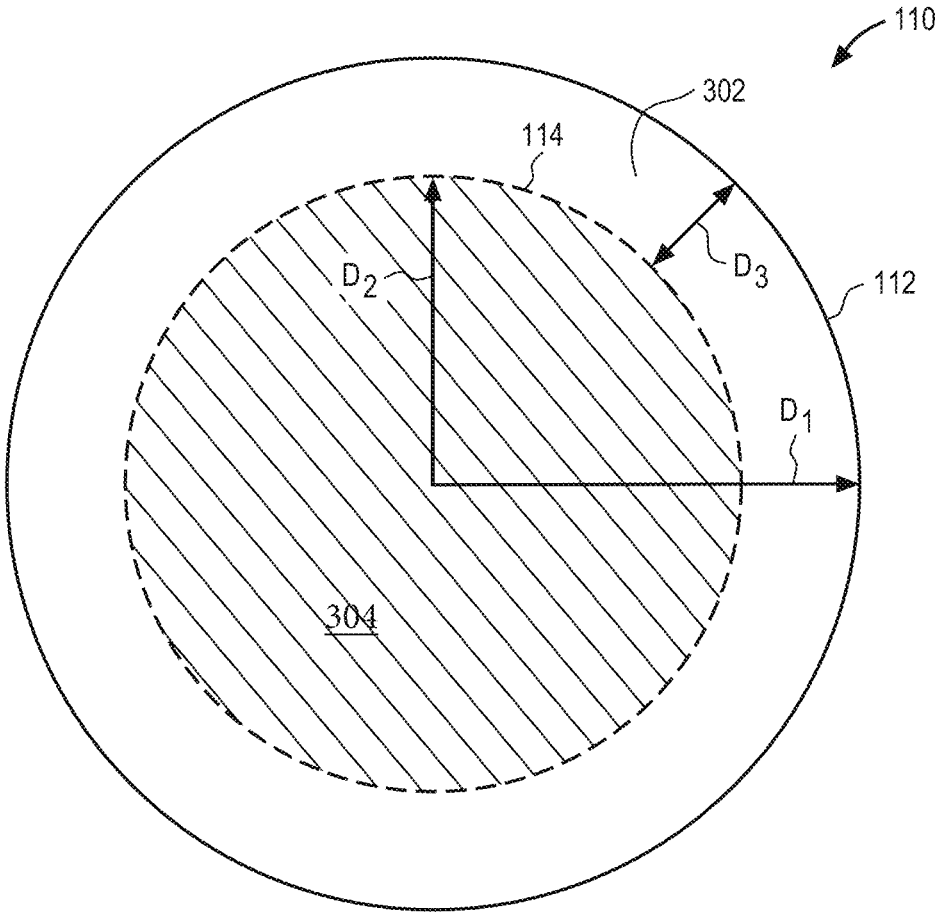
FIG. 3 illustrates a top plan view of one aspect of an acoustic shielding assembly.

The corresponding acoustic shielding assembly 110 dimensions, which are determined based on graph 200, are illustrated in FIG. 3. In particular, where the acoustic port is circular as previously discussed, the associated acoustic mesh 112 used to cover the port may have a maximum dimension D1, which in this case may be a maximum outer radius (e.g., radius (Ro) described in FIG. 2) or diameter (e.g., 2×D1). In some cases, a maximum outer diameter of acoustic mesh 112 may be 1.5 cm or less, for example, 1.4 cm or less, 1.3 cm or less, 1.2 cm or less or 1.1 cm or less. The support member 114 used to occlude a portion of the acoustic mesh 112 may have a maximum dimension D2 (e.g., inner radius (Ri) described in FIG. 2). This section, region or portion of the acoustic mesh 112 in contact with support member 114 forms the acoustically closed portion 304 of the acoustic mesh 112. In other words, the acoustically closed portion 304 may be understood as also having a maximum dimension D2. As can be seen from FIG. 3, the maximum dimension D2 is less than the maximum dimension D1 of acoustic mesh 112. An acoustically open portion 302 having a maximum dimension D3 (e.g., open area (g) of FIG. 2) therefore remains near the perimeter of acoustic mesh 112. In this configuration, support member 114 is positioned within the center region of acoustic mesh 112. Therefore, the acoustically open portion 302 of acoustic mesh 112 is a ring shaped region occupying an entire perimeter of acoustic mesh 112, and the center of the mesh is the acoustically close portion 304. It is contemplated, however, that the acoustically open portion 302 and acoustically closed portion 304 of mesh 112 may have different shapes and sizes and are not limited to circular shapes. To achieve the desired wind noise attenuation, however, D2 should be less than D1, or D3 should be greater than zero. In some aspects, it is contemplated that the dimensions D1, D2 and D3 may represent a surface area of the acoustic mesh 112, support member 114 (or acoustically closed portion 304) and acoustically open portion 302, respectively. In some aspects, the configuration of the shielding assembly 110 may therefore also be described based on a surface area of the closed portion relative to the open portion. For example, in some aspects, the surface area of the acoustically closed portion 304 of acoustic mesh (e.g., D2) may be larger than a surface area of the acoustically open portion 302 of acoustic mesh (e.g., D3). In other aspects, the surface area ratio for the entire surface area of acoustic mesh 112 (e.g., D1) to the surface area of the acoustically closed portion 302 (e.g., D3) may be 1.04. Said another way, the surface area of acoustically open portion 302, or dimension D3, may be at least 1 percent of the entire surface area of acoustic mesh 112 (e.g., D1). It should further be understood that the acoustically open portion 302 and the acoustically closed portion 304 are both formed by the same mesh material making up acoustic mesh 112. For example, the acoustically open portion 302 and the acoustically closed portion 304 may be formed from the same sheet of pliable, porous material, such as a porous polyester, making up the acoustic mesh 112. The acoustically open portion 302, however, is considered acoustically open because sounds and/or noise may pass through the acoustically open portion 302 to the underlying acoustic chamber but are prevented from passing through the acoustically closed portion 304 to the underlying acoustic chamber.

Figure 4:
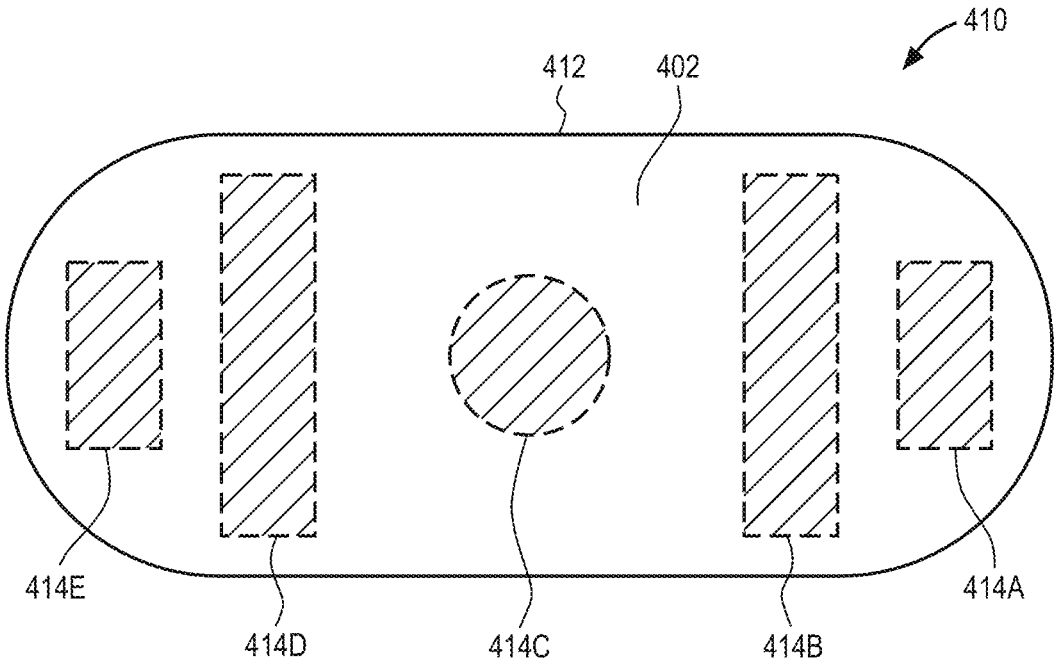
FIG. 4 illustrates a top plan view of another aspect of an acoustic shielding assembly.

It should further be understood that while a circular configuration is described in FIGS. 2-3, it is contemplated that the acoustic port 108 and acoustic shielding assembly 110 may have other shapes and configurations. FIG. 4 illustrates a top plan view of another aspect of an acoustic shielding assembly associated with an elongated acoustic port. Representatively, acoustic shielding assembly 410 may have an acoustic mesh 412 having an elongated shape as shown, which may correspond to the shape and dimensions of the associated acoustic port (although not shown). Assembly 410 may further include a number of support members 414A, 414B, 414C, 414D, 414E contacting the acoustic mesh 412. Therefore, in this configuration, the acoustic mesh 412 includes a number of sections, portions or regions that are acoustically closed (e.g, sections covered by members 414A, 414B, 414C, 414D, 414E) and the surrounding mesh portion 402 is acoustically open, as opposed to a single centrally occluded portion and open perimeter portion as previously discussed. The total occluded and open surface areas of acoustic mesh 412, however, may still be the same when single support member is used, therefore the same wind noise attenuation can ultimately be achieved.

Figure 5A:
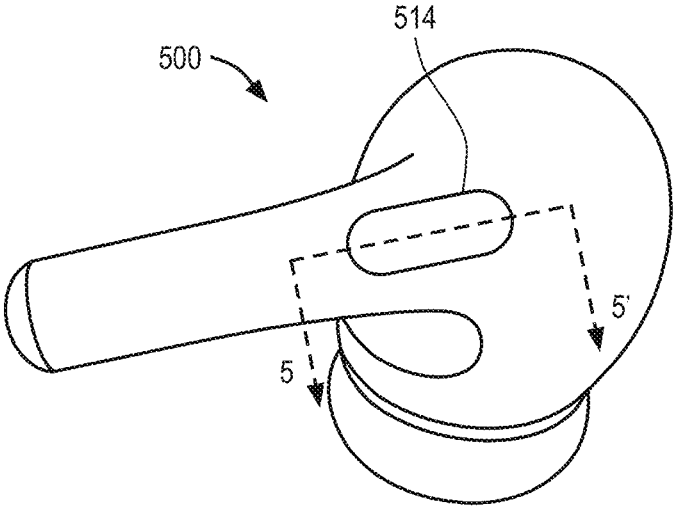
FIGS. 5A-5B illustrates perspective and cross-sectional views of one aspect of an exemplary acoustic shielding component for a microphone in a housing.
Figure 5B:
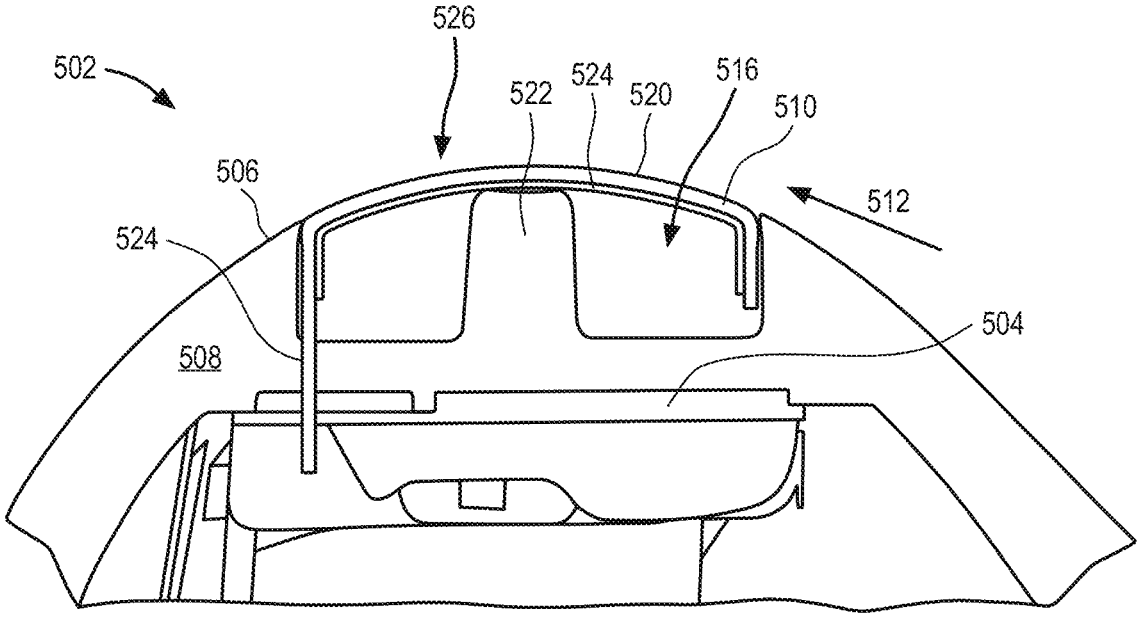

FIGS. 5A-5B illustrate another aspect of an acoustic shielding assembly associated with a device. FIG. 5A illustrates a perspective view of a portable electronic device within which the acoustic shielding assembly may be implemented. For example, the portable electronic device may be a portable listening device 500 having an acoustic port 514. FIG. 5B illustrates a cross-sectional view taken along line 5-5' of device 500. From this view, it can be seen that shielding assembly 502 may be coupled to the acoustic port 514. The acoustic shielding assembly 502 may include acoustic mesh 510. Acoustic mesh 510 can be a single or multi-layer mesh structure that extends at least partially between externally facing microphone 504 and an outer surface 506 of enclosure 508. For instance, an external surface 520 of the acoustic mesh 510 can face outside of enclosure 508 and be substantially planar with the immediately adjacent regions of external surface 506 of enclosure 508. External surface 520 of acoustic mesh 510 can be curved to seamlessly integrate with (i.e., be flush with) the curvature/profile of outer surface 506 of enclosure 508 so that structural step formations and recesses at their interface can be avoided, thereby substantially mitigating the generation of acoustic turbulence as air 512 moves quickly past acoustic port 526 while still enabling external noise to filter through to microphone 504.

In some instances, acoustic mesh 510 is relatively thin compared to the depth of opening 526. Thus, because external surface 520 of mesh 510 is positioned planar with external surface 506 of enclosure 508, a cavity 516 within enclosure 508 and below external surface 520 of acoustic mesh 510 can be defined by the structure of acoustic mesh 510. The relatively large surface area of external surface 520 of acoustic mesh 510 along with its thin construction and position relative to cavity 516, acoustic mesh 510 may be particularly vulnerable to deformation during drop events. Thus, to resist such deformation, a support member 522 can be abutted against an inner surface 524 of acoustic mesh 510 opposite from external surface 520. Support member 522 can be a support post that is an extension of housing 508 that extends toward, and makes contact with, acoustic mesh 510, and occludes a portion of acoustic mesh 510. Support member 522 can be positioned so that it makes contact with a central region of acoustic mesh 510 as shown. In addition to support member 522, an additional stiffener can be implemented to provide structural rigidity to acoustic mesh 510, and a grounding tab 524 can couple the acoustic mesh 510 to ground for additional support.

Figure 6:
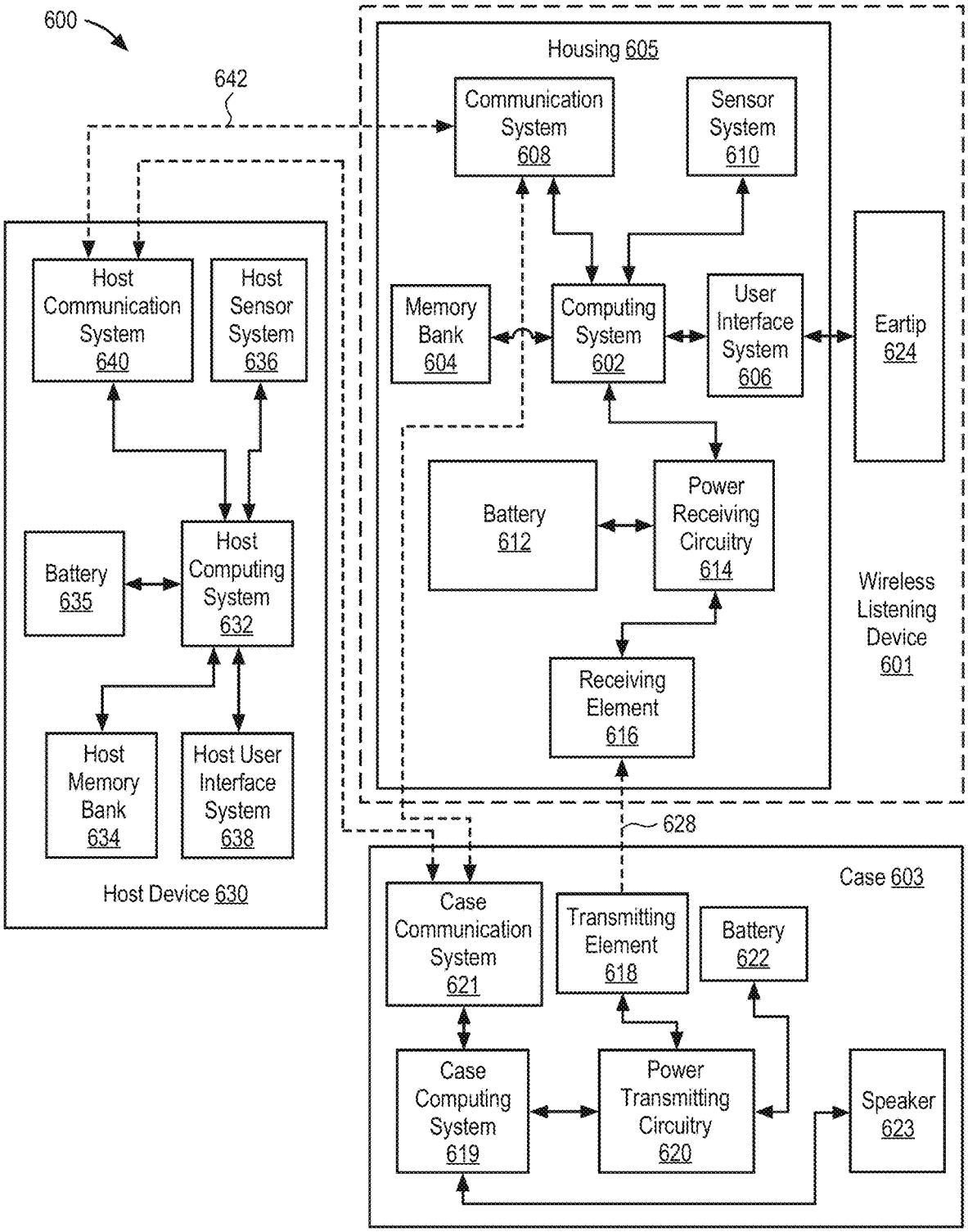
FIG. 6 illustrates is a block diagram of a portable electronic listening device system including an exemplary wireless listening device with which an acoustic shielding component may be associated.

FIG. 6 illustrates a block diagram of some of the constituent components of a portable listening device in which the acoustic shield assembly disclosed herein may be implemented. The portable electronic listening device system 600 may include an exemplary wireless listening device 601, according to some embodiments of the present disclosure. Wireless listening device 601, as mentioned above, can include a housing 605. Housing 605 can be an electronic device component that generates and receives sound to provide an enhanced user interface for a host device 630. Housing 605 can include a computing system 602 coupled to a memory bank 604. Computing system 602 can execute instructions stored in memory bank 604 for performing a plurality of functions for operating housing 605. Computing system 602 can be one or more suitable computing devices, such as microprocessors, computer processing units (CPUs), graphics processing units (GPUs), field programmable gate arrays (FPGAs), and the like.

Computing system 602 can also be coupled to a user interface system 606, communication system 608, and a sensor system 610 for enabling housing 605 to perform one or more functions. For instance, user interface system 606 can include a driver (e.g., speaker) for outputting sound to a user, microphone for inputting sound from the environment or the user, and any other suitable input and output device. Communication system 608 can include Bluetooth components for enabling housing 605 to send and receive data/commands from host device 630. Sensor system 610 can include optical sensors, accelerometers, microphones, and any other type of sensor that can measure a parameter of an external entity and/or environment.

Housing 605 can also include a battery 612, which can be any suitable energy storage device, such as a lithium ion battery, capable of storing energy and discharging stored energy to operate housing 605. The discharged energy can be used to power the electrical components of housing 605. In some embodiments, battery 612 can also be charged to replenish its stored energy. For instance, battery 612 can be coupled to power receiving circuitry 614, which can receive current from receiving element 616. Receiving element 616 can electrically couple with a transmitting element 618 of a case 603 in embodiments where receiving element 616 and transmitting element 618 are configured as exposed electrical contacts. Case 603 can include a battery 622 that can store and discharge energy to power transmitting circuitry 620, which can in turn provide power to transmitting element 618. The provided power can transfer through an electrical connection 628 and be received by power receiving circuitry 614 for charging battery 612. While case 603 can be a device that provides power to charge battery 612 through receiving element 616, in some embodiments, case 603 can also be a device that houses wireless listening device 601 for storing and provide protection to wireless listening device 601 while it is stored in case 603.

Case 603 can also include a case computing system 619 and a case communication system 621. Case computing system 619 can be one or more processors, ASICs, FPGAs, microprocessors, and the like for operating case 603. Case computing system 619 can be coupled to power transmitting circuitry 620 for operating the charging functionalities of case 603, and case computing system 619 can also be coupled to case communication system 621 for operating the interactive functionalities of case 603 with other devices, e.g., housing 605. In some embodiments, case communication system 621 is a Bluetooth component, or any other suitable communication component, that sends and receives data with communication system 608 of housing 605, such as an antenna formed of a conductive body. That way, case 603 can be apprised of the status of wireless listening device 601 (e.g., charging status and the like). Case 603 can also include a speaker 623 coupled to case computing system 619 so that speaker 623 can emit audible noise capable of being heard by a user for notification purposes.

Host device 630, to which housing 605 is an accessory, can be a portable electronic device, such as a smart phone, tablet, or laptop computer. Host device 630 can include a host computing system 632 coupled to a host memory bank 634 containing lines of code executable by host computing system 632 for operating host device 630. Host device 630 can also include a host sensor system 636, e.g., accelerometer, gyroscope, light sensor, and the like, for allowing host device 630 to sense the environment, and a host user interface system 638, e.g., display, speaker, buttons, touch screen, and the like, for outputting information to and receiving input from a user. Additionally, host device 630 can also include a host communication system 640 for allowing host device 630 to send and/or receive data from the Internet or cell towers via wireless communication, e.g., wireless fidelity (WIFI), long term evolution (LTE), code division multiple access (CDMA), global system for mobiles (GSM), Bluetooth, and the like. In some embodiments, host communication system 640 can also communicate with communication system 608 in housing 605 via wireless communication line 642 so that host device 630 can send sound data to housing 605 to output sound, and receive data from housing 605 to receive user inputs. Communication line 642 can be any suitable wireless communication line such as Bluetooth connection. By enabling communication between host deice 630 and housing 605, wireless listening device 601 can enhance the user interface of host device 630. FIG. 5 illustrates an example of a representative portable electronic listening device system.

While certain aspects have been described and shown in the accompanying drawings, it is to be understood that such embodiments are merely illustrative of and not restrictive on the broad invention, and that the invention is not limited to the specific constructions and arrangements shown and described, since various other modifications may occur to those of ordinary skill in the art. The description is thus to be regarded as illustrative instead of limiting. In addition, to aid the Patent Office and any readers of any patent issued on this application in interpreting the claims appended hereto, applicants wish to note that they do not intend any of the appended claims or claim elements to invoke 35 U.S.C. 112(f) unless the words "means for" or "step for" are explicitly used in the particular claim.

The invention claimed is:

1. An acoustic mesh comprising:

a first portion that is acoustically closed by a support post contacting at least a complete center of the acoustic mesh, the support post extending from a base portion of an enclosure that defines an acoustic cavity over which the acoustic mesh is positioned; and a second portion that surrounds the first portion and is acoustically open, wherein the acoustic mesh provides a wind noise attenuation of 10 decibels or less.

2. The acoustic mesh of claim 1 wherein the second portion comprises a surface area that is at least 1 percent a total surface area of the acoustic mesh.

3. The acoustic mesh of claim 1 wherein the second portion is near a perimeter of the acoustic mesh.

4. The acoustic mesh of claim 1 wherein the second portion is a ring shaped portion positioned around the first portion.

5. The acoustic mesh of claim 1 wherein the first portion comprises a number of portions that acoustically close different sections of the acoustic mesh.

6. The acoustic mesh of claim 1 wherein the first portion comprises a diameter, and the diameter of the first portion is 1.5 cm or less.

7. The acoustic mesh of claim 1 wherein the acoustic mesh is coupled to an acoustic port of the acoustic cavity and a microphone is positioned within the acoustic cavity.

8. The acoustic mesh of claim 7 wherein the support post is positioned between the microphone and the acoustic port, and the support posts contacts an inner surface of the acoustic mesh that faces the acoustic cavity.

9. An acoustic shielding assembly comprising:

an acoustic mesh;

a support member having an enclosed top side contacting an inner surface of at least a center portion of the acoustic mesh to acoustically close the center portion of the acoustic mesh, and wherein a dimension of the support member is selected to allow the acoustic mesh to attenuate wind noise without affecting a frequency response of a microphone to which the acoustic mesh is acoustically coupled.

10. The acoustic shielding assembly of claim 9 wherein the center portion of the acoustic mesh is a first portion and a second portion of the acoustic mesh surrounding the first portion is acoustically open.

11. The acoustic shielding assembly of claim 9 wherein the dimension of the support member is a radius and the acoustic mesh comprises a radius that is greater than the radius of the support member.

12. The acoustic shielding assembly of claim 9 wherein a diameter of the acoustic mesh is 1.5 cm or less.

13. The acoustic shielding assembly of claim 9 wherein the attenuation of wind noise is 10 decibels or less.

14. The acoustic shielding assembly of claim 9 wherein the acoustic mesh is coupled to an acoustic port that opens to an acoustic cavity of the microphone.

15. The acoustic shielding assembly of claim 14 wherein the support member is a post positioned within the acoustic cavity and that extends to the acoustic mesh.

16. A portable electronic device, comprising:

an enclosure having an acoustic port that acoustically couples an acoustic cavity within the enclosure to a surrounding ambient environment;

a microphone positioned within the enclosure and acoustically coupled to the acoustic cavity;

an acoustic mesh coupled to the acoustic port; and a support member formed from the enclosure as a unitary structure and extending from a top side of the microphone to a center portion of the acoustic mesh to acoustically close the center portion of the acoustic mesh, and wherein a remaining portion of the acoustic mesh surrounding the center portion is acoustically open and surrounds the center portion, and wherein the remaining portion comprises a surface area that is at least 1 percent a total surface area of the acoustic mesh.

17. The portable electronic device of claim 16 wherein the acoustically closed center portion prevents a wind noise from the ambient environment from entering the acoustic cavity.

18. The portable electronic device of claim 16 wherein the acoustically closed center portion is at a center of the acoustic mesh.

19. The portable electronic device of claim 16 wherein the support member comprises a radius that is smaller than a radius of the acoustic port.

* * * * *